United States Patent [19]

Mehta

[11] Patent Number: 4,510,078

[45] Date of Patent: Apr. 9, 1985

[54] OILED, ELECTRICALLY CONDUCTIVE CARBON BLACK

[75] Inventor: Aspy K. Mehta, Baton Rouge, La.

[73] Assignee: Union Carbide Corp., Danbury, Conn.

[21] Appl. No.: 523,277

[22] Filed: Aug. 15, 1983

Related U.S. Application Data

[62] Division of Ser. No. 221,153, Dec. 29, 1980.

[51] Int. Cl.[3] ..... H01B 1/06

[52] U.S. Cl. ..... 252/510; 252/502; 524/495; 524/496; 423/460

[58] Field of Search ..... 252/511, 510; 524/495, 524/496, 543, 560, 442, 449, 451, 474, 484, 487; 174/102 R, 102 SC, 102 C; 423/445, 447.2, 460; 427/221; 428/403, 408

[56] References Cited

U.S. PATENT DOCUMENTS

| | | | |
|---|---|---|---|
| 2,440,299 | 4/1948 | Rostler | 524/445 |
| 3,105,825 | 10/1963 | Stratford | 523/334 |
| 3,203,921 | 8/1965 | Rosenfelder | 524/451 |
| 3,206,419 | 9/1965 | Prichard et al. | 524/157 |
| 3,351,495 | 11/1967 | Larsen et al. | 429/252 |
| 4,008,113 | 2/1977 | Glander et al. | 156/52 |
| 4,026,863 | 5/1977 | Iseki et al. | 523/205 |
| 4,098,968 | 7/1978 | Wortmann et al. | 524/496 |
| 4,151,126 | 4/1976 | Adelman et al. | 252/511 |
| 4,321,162 | 3/1982 | Guffens et al. | 252/511 |
| 4,360,627 | 11/1982 | Okado et al. | 524/496 |

FOREIGN PATENT DOCUMENTS

| | | |
|---|---|---|
| 1076849 | 7/1967 | United Kingdom . |
| 1158974 | 7/1969 | United Kingdom . |

OTHER PUBLICATIONS

Publication—By Process Economics Program, May, 1974, Stanford Research Institute, pp. 185–187.

*Primary Examiner*—Josephine L. Barr

*Attorney, Agent, or Firm*—James C. Arvantes; Robert C. Brown

[57] ABSTRACT

Electrically conductive compositions comprising an ethylene polymer, a mineral filler and carbon black having a surface area greater than about 500 $m^2$/gram, these compositions being useful as extrudates about electrical conductors providing conductive shields thereon.

1 Claim, No Drawings

OILED, ELECTRICALLY CONDUCTIVE CARBON BLACK

This application is a division of prior U.S. application Ser. No. 221,153, filed Dec. 29, 1980.

SUMMARY OF THE INVENTION

This invention relates to electrically conductive compositions comprising an ethylene polymer, a mineral filler and an oiled, electrically conductive carbon black having an $N_2$ surface area greater than about 500 $m^2$/gram. The compositions of this invention are characterized by improved physical properties and improved electrical conductivity indicating improved dispersibility of the carbon black in the compositions. Consequently, the compositions are particularly useful as extrudates about electrical conductors serving as conductive shields.

BACKGROUND OF THE INVENTION

Compositions based on ethylene polymers and containing carbon black have been used, extensively, in the production of conductive shields about electrical cables. Conductive shields are essential components of cable design and construction serving, in electrical power cables, as conductor and insulation shields and also providing protection against short circuits.

Ethylene polymer compositions, from which conductive shields are produced, are prepared by admixing an ethylene polymer, conductive carbon black and other components such as an antioxidant and, if the compositions are to be crosslinked, an organic peroxide. A key parameter with respect to such compositions is the degree of dispersion of the carbon black in the polymer matrix. The degree of carbon black dispersion directly controls the homogeniety of the compositions which in turn affects the physical and electrical properties thereof. Also, when the compositions are used to form conductive shields about electrical cables, good dispersion of the carbon black is essential for long term cable reliability. Carbon black agglomerates tend to form protrusions at the interface between the insulation and the conductive shield of the electrical cable. These protrusions become points of electrical stress leading to cable failure.

The problem of carbon black dispersibility has been accentuated in recent years due to the increased use of carbon black having a high surface area, generally in excess of about 500 $m^2$/gram, in formulating compositions to be used in the extrusion of conductive shields about cables. It has been found that reduced amounts of carbon black having a high surface area can be used to provide equivalent product conductivities, compared to compositions containing standard carbon blacks. Compositions, therefore, have been formulated containing increased amounts of polymer which enhance certain properties in the resultant compositions.

Despite improvement in properties, the successful commercial utilization of these carbon blacks has been hampered by processing difficulties, specifically poor dispersibility in the polymer matrix. As a result, it has been necessary to utilize extensive compounding procedures and/or special equipment in order to insure that high surface area carbon black is adequately dispersed in the polymer matrix.

DESCRIPTION OF THE INVENTION

The present invention provides compositions in which the high surface area carbon blacks are dispersed, without the utilization of extensive compounding procedures and/or special equipment, to a degree such that compositions are characterized by improved physical and electrical properties.

The compositions of this invention comprise an ethylene polymer, a mineral filler and an oiled, electrically conductive carbon black having an $N_2$ surface area greater than about 500 $m^2$/gram (ASTM D 3037-76) wherein the oiled carbon black is present in an amount of about 5 to about 25 percent by weight, preferably about 10 to about 15 percent by weight and the mineral filler is present in an amount of about 5 to about 30 percent by weight, preferably about 10 to about 20 percent by weight; based on the weight of the total composition.

The compositions can be extruded about cables to provide conductive shields thereon and the cables, depending upon the construction, used in electrical or communication applications.

The ethylene polymers which are used in the compositions of the present invention are solid (at 25° C.) materials which may be homopolymers, or copolymers of ethylene. The ethylene copolymers contain at least about 30 percent by weight of ethylene and up to about 70 percent by weight of propylene, and/or up to about 50 percent by weight of one or more other organic compounds which are interpolymerizable with ethylene. Compounds which are interpolymerizable with ethylene are preferably those which contain polymerizable unsaturation, such as is present in compounds containing an ethylene linkage, $>C{=}C<$. Exemplary of such compounds are butene-1, pentene-1, isoprene, butadiene, bicycloheptene, bicycloheptadiene, stryene, as well as vinyl compounds, such as vinyl acetate and alkyl acrylates.

Particularly desirable ethylene polymers for purposes of this invention are normally solid copolymers of ethylene and an alkyl acrylate having a melt index of about 2 to about 24 and containing about 12 to about 25 percent by weight combined alkyl acrylate, based on the total weight of the copolymer.

Combined alkyl acrylate content is conveniently determined by standard infrared analysis.

A detailed description of suitable ethylene-alkyl acrylate copolymers, particularly ethylene-ethyl acrylate copolymers and a method for the production thereof is to be found in U.S. Pat. No. 2,953,551 to Wayne G. White patented Sept. 20, 1960.

Suitable alkyl acrylate monomers which are copolymerized with ethylene to produce the ethylene-alkyl acrylate copolymers of this invention fall within the scope of the following formula:

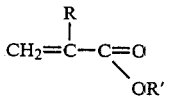

wherein R is hydrogen or methyl and R′ is alkyl having one to 8 carbon atoms inclusive. Illustrative of compounds encompassed by this formula are the following: methyl acrylate, ethyl acrylate, ethyl methacrylate, n-butyl acrylate, t-butyl acrylate, n-butyl methacrylate, 2-ethylhexyl acrylate and the like.

If desired, more than one ethylene polymer can be admixed to produce the compositions of this invention.

Carbon blacks having an $N_2$ surface area greater than about 500 $m^2$/gram are known products and sold commercially under such trade names as "KETJEN-BLACK EC".

The oiling of these carbon blacks is carried out using a paraffin mineral oil of lubricating viscosity by admixing, the carbon black and oil in a weight ratio, of carbon black to oil, of about 3:1 to about 1:1.

Mineral fillers suitable for purposes of this invention include clay, silica, calcium carbonate and the like.

A preferred mineral filler is talc, including talc coated with a fatty acid or a metal salt of a fatty acid. As to the metal salts of fatty acids, the metal component falls in Groups Ia, IIa or IIb of the Mendeleev Period Table of Elements. Fatty acids which are used per se or used to form the metal salts are saturated or unsaturated monobasic or dibasic, branched or straight chain fatty acids of 8 to 20 carbon atoms. Such acids that may be included within the practice of this invention, but not limited thereto, are palmitic, stearic, lauric, oleic, sebacic, ricinoleic, palmitoleic and the like. The preferred acid is stearic acid while the preferred metal salts are calcium stearate and zinc stearate. The talc filler may be coated by mixing the talc, fatty acid or metallic salt of fatty acid, and ethylene polymer together in a mixer. Preferably, however, the talc filler is precoated with a fatty acid or metallic salt of a fatty acid by known techniques prior to mixing the talc with the ethylene polymer, as for example by admixing about 0.05 to about 5 parts by weight fatty acid or metal salt per 100 parts by weight talc.

The compositions of this invention may also contain various additives, for example, to plasticize, to stabilize, to lubricate, to prevent oxidation and to crosslink. Such additives are well known and may be added to the compositions of this invention in convenient amounts, as is well known by those skilled in the art.

Illustrative of such additives are substituted phenols, thio-bisphenols, aromatic amines, dyes, pigments, ultraviolet light absorbents, fatty acid amides, organic peroxides, rubbers and the like.

The following examples further illustrate the present invention and are not intended to limit the scope thereof in any manner.

Amounts are in parts by weight unless otherwise noted.

EXAMPLE 1

Compositions were prepared by admixing the components thereof in a Banbury Batch Mixer for a period of 3 minutes at a temperature of 150° C. Each composition was then extruded into thin tapes, 1 inch wide and 0.020 inch thick, at a temperature of 150° C. in a one inch laboratory tape extruder.

Each tape was examined visually and rated on a scale of 1 to 5 for quality of carbon black dispersion and surface smoothness. A tape rated number 1 has superior carbon black dispersion and no surface roughness. A rating above 5 indicates unacceptable carbon black dispersion and the composition from which the tape was produced, is considered to be unsatisfactory for use in the production of conductive shields about electrical conductors.

| FORMULATION | CONTROL 1 | EXAMPLE 1 |
|---|---|---|
| Copolymer of ethylene-ethyl acrylate containing 12 percent by weight combined ethyl acrylate and having a melt index of 1.5 (ASTM D-1248) | 84.5 | 64.5 |
| Talc | — | 20.0 |
| Carbon Black | 15.0 | 15.0 |
| Polymerized 1,2-dihydro-2,2,4-trimethyl quinoline (antioxidant) | 0.5 | 0.5 |
| Rating (Tape) | >5 | 2 |

The carbon black used in Example 1 had an $N_2$ surface area of 1,000 $m^2$/gram. This black was oiled by admixing 2 parts by weight carbon black with one part by weight white mineral oil at room temperature.

Compositions, the formulations of which are set forth below, were prepared as previously described and tested for resistance to heat distortion (ICEA S-66-524). A value of about 10 to about 15 percent indicates that the composition tested is more suitable for use as conductive shielding material.

| FORMULATION | CONTROL 2 | EXAMPLE 2 |
|---|---|---|
| Copolymer of ethylene-ethyl acrylate-same as in Example 1 | 59.8 | 44.8 |
| Talc | — | 15.0 |
| Carbon Black-same as in Example 1 | 15.0 | 15.0 |
| Antioxidant-same as in Example 1 | 0.2 | 0.2 |
| Polyethylene-density-0.95 grams/cc (ASTM D-1505) melt index 21 g/10 min. | 20.0 | 20.0 |
| Ethylene-propylene rubber | 5.0 | 5.0 |
| Rating (Tape) | 4–5 | 2–3 |
| Percent Heat Distortion at 121° C. | 50 | 12.0 |

Compositions, the formulations of which are set forth in Table I were prepared by admixing the components in a Banbury Batch mixer at a temperature of about 150° C. for three minutes.

A composition of this invention, Example 3, was compared to a composition (Control 3) standard for use as a conductive shield about an electrical conductor and a composition (Control4) which did not contain carbon black.

TABLE 1

| FORMULATION | EXAMPLE 3 | CONTROL 3 | CONTROL 4 |
|---|---|---|---|
| Copolymer of ethylene-alkyl acrylate (same as in Example 1) | 56.7 | 82.45 | 79.7 |
| Carbon Black $N_2$ Surface Area 1000 $m^2$/g | 11.5 | 11.5 | — |
| Talc | 20.0 | — | 20 |
| Antioxidant (same as in Example 1) | 0.3 | 0.3 | 0.3 |
| White Mineral Oil (premixed with carbon black prior to compounding) | 11.5 | 5.75 | — |
| Volume Resistivity (Ohm-cm) Thin Extruded Tapes (1.0 inch wide, 0.020 inch thick)(ASTM D 991) | | | |
| 23° C. | 12 | 49 | Not Conductive ($10^{14}$) |
| 90° C. | 21 | 138 | |
| 90° C. after 2 weeks | 30 | 291 | |
| 90° C. after 4 weeks | 49 | 1029 | |
| 90° C. after 6 weeks | 35 | 5344 | |

TABLE 1-continued

| FORMULATION | EXAMPLE 3 | CONTROL 3 | CONTROL 4 |
|---|---|---|---|
| 90° C. after 8 weeks | 34 | 4166 | |

a composition containing both talc and oiled carbon black has signficantly improved electrical conductivity which is maintained at elevated temperatures (Example 3).

The following Examples and Control illustrate the affect of filler concentration on electrical conductivity.

TABLE II

| FORMULATION | PERCENT BY WEIGHT | | | | |
|---|---|---|---|---|---|
| | CONTROL 5 | EXAMPLE 4 | EXAMPLE 5 | EXAMPLE 6 | EXAMPLE 7 |
| Copolymer of Ethylene-Ethyl Acrylate (same as in Example 1) | 86.9 | 81.9 | 76.9 | 71.9 | 66.9 |
| Carbon Black | 10.0 | 10.0 | 10.0 | 10.0 | 10.0 |
| Talc | — | 5.0 | 10 | 15.0 | 20.0 |
| Antioxidant* | 0.1 | 0.1 | 0.1 | 0.1 | 0.1 |
| White Mineral Oil (premixed with carbon black prior to compounding) | 3.0 | 3.0 | 3.0 | 3.0 | 3.0 |
| Volume Resistivity (Ohm-cm) Thin extruded tapes (1.0 inch wide, 0.020 inch thick) | 62,967 | 49,804 | 1,113 | 557 | 306 |

*Antioxidant was thiodiethylene bis-(3,5-di-tert-butyl-4-hydroxy) hydrocinnamate The data set forth in Table I shows that;

the addition of talc per se to a composition does not render that composition electrically conductive (Control 4);

the addition of oiled carbon black to the same composition, without the talc, renders the composition electrically conductive (Control 3);

What is claimed is:

1. Carbon black having a surface area of about 1000 $m^2$/gram oiled with a white mineral oil of lubricating viscosity, by admixing said carbon black with said white mineral oil in a weight ratio of carbon black to oil of about 3:1 to about 1:1.

* * * * *